US008850780B2

(12) United States Patent
Fontanazzi et al.

(10) Patent No.: US 8,850,780 B2
(45) Date of Patent: Oct. 7, 2014

(54) MEMBER AND METHOD FOR FORMING SEALED PACKAGES OF POURABLE FOOD PRODUCTS FROM A TUBE OF PACKAGING MATERIAL

(71) Applicant: Tetra Laval Holdings & Finance S.A., Pully (CH)

(72) Inventors: Paolo Fontanazzi, Modena (IT); Giorgio Mattioli, Modena (IT); Franco Santi, Modena (IT); Stefano Caselli, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 13/748,897

(22) Filed: Jan. 24, 2013

(65) Prior Publication Data

US 2013/0133291 A1 May 30, 2013

Related U.S. Application Data

(63) Continuation of application No. 12/668,532, filed as application No. PCT/EP2008/062996 on Sep. 29, 2008, now Pat. No. 8,407,974.

(30) Foreign Application Priority Data

Sep. 28, 2007 (EP) ..... 07425602

(51) Int. Cl.

| | |
|---|---|
| ***B65B 7/06*** | (2006.01) |
| ***B65B 3/02*** | (2006.01) |
| ***B65B 51/30*** | (2006.01) |
| ***B65B 9/20*** | (2012.01) |
| ***B65B 9/207*** | (2012.01) |

(52) U.S. Cl.

CPC . *B65B 3/02* (2013.01); *B65B 51/30* (2013.01); *B65B 9/2049* (2013.01); *B65B 9/207* (2013.01)

USPC ..... 53/481; 53/477; 53/371.7; 53/372.2; 53/374.6; 493/311

(58) Field of Classification Search

USPC ..... 53/477, 481, 370.7, 371.7, 372.2, 53/373.7, 374.6; 493/311

See application file for complete search history.

(56) References Cited

U.S. PATENT DOCUMENTS 3,148,489 A * 9/1964 Senior et al. ..... 53/412
4,387,547 A * 6/1983 Reil ..... 53/131.5

(Continued)

FOREIGN PATENT DOCUMENTS

EP 0 829 425 A2 3/1998
EP 1 526 074 A1 4/2005

(Continued)

OTHER PUBLICATIONS

Russian Decision on Grant dated Nov. 25, 2013 issued in the corresponding Russian Patent Application No. 2010116705 and English language translation.

(Continued)

*Primary Examiner* — Stephen F Gerrity
*Assistant Examiner* — Eyamindae Jallow
(74) *Attorney, Agent, or Firm* — Buchanan Ingersoll & Rooney PC

(57) ABSTRACT

A forming member for controlling the volume of packages of pourable food products formed from a tube of packaging material and sealed at a number of sections of the tube crosswise to an axis of the tube; the forming member having: a main wall which cooperates cyclically with a first portion of the tube extending between two consecutive sections; and at least one flap extending alongside the wall. The flap is movable, with respect to the wall, between a first position, in which it cooperates with a second portion of the tube, extending between the two consecutive sections, to control the volume, between the two consecutive sections, of the package being formed, and a second position, in which it is detached from the second portion.

19 Claims, 9 Drawing Sheets

(56) References Cited

U.S. PATENT DOCUMENTS

| | | | | |
|---|---|---|---|---|
| 4,580,392 | A * | 4/1986 | Lagerstedt et al. | 53/451 |
| 4,628,670 | A * | 12/1986 | Kondo et al. | 53/551 |
| 5,767,491 | A * | 6/1998 | Ohlsson et al. | 219/633 |
| 5,787,681 | A * | 8/1998 | Papina et al. | 53/373.7 |
| 5,970,687 | A | 10/1999 | Katayama et al. | |
| 6,038,838 | A * | 3/2000 | Fontanazzi | 53/551 |
| 6,070,395 | A * | 6/2000 | Calvano | 53/451 |
| 6,085,495 | A * | 7/2000 | Fontanazzi et al. | 53/551 |
| 6,112,498 | A | 9/2000 | Hansson et al. | |
| 6,161,366 | A * | 12/2000 | Bausch et al. | 53/477 |
| 6,212,861 | B1 * | 4/2001 | Tsuruta | 53/551 |
| 6,397,565 | B2 * | 6/2002 | Ohshita | 53/501 |
| 6,526,733 | B1 * | 3/2003 | Schellenberg et al. | 53/551 |
| 6,543,205 | B1 * | 4/2003 | Faskhoody et al. | 53/373.7 |
| 6,877,295 | B1 | 4/2005 | Benedetti et al. | |
| 7,059,100 | B2 | 6/2006 | Babini et al. | |
| 7,104,028 | B2 * | 9/2006 | Paradisi et al. | 53/374.5 |
| 7,448,188 | B2 * | 11/2008 | Hauers et al. | 53/551 |
| 7,484,347 | B2 * | 2/2009 | Konno et al. | 53/551 |
| 7,748,201 | B2 | 7/2010 | Poppi | |
| 2005/0172574 | A1 * | 8/2005 | Paradisi et al. | 53/374.2 |
| 2007/0068122 | A1 | 3/2007 | Poppi | |
| 2008/0289303 | A1 * | 11/2008 | Nemkov et al. | 53/552 |
| 2009/0090088 | A1 * | 4/2009 | Nemkov et al. | 53/477 |
| 2010/0287892 | A1 * | 11/2010 | Gill et al. | 53/477 |
| 2011/0192117 | A1 * | 8/2011 | Lubezny et al. | 53/456 |

FOREIGN PATENT DOCUMENTS

| | | | |
|---|---|---|---|
| RU | 2253599 | C2 | 6/2005 |
| SU | 426917 | A1 | 5/1974 |

OTHER PUBLICATIONS

International Search Report issued by the European Patent Office on Aug. 12, 2008 as the International Searching Authority in International Application No. PCT/EP2008/062996.

Written Opinion issued by the European Patent Office on Aug. 12, 2008 as the International Searching Authority in International Application No. PCT/EP2008/062996.

* cited by examiner

MEMBER AND METHOD FOR FORMING SEALED PACKAGES OF POURABLE FOOD PRODUCTS FROM A TUBE OF PACKAGING MATERIAL

CROSS REFERENCE TO RELATED APPLICATION

This application is a continuation of application Ser. No. 12/668,532, filed Jan. 11, 2010, which is the National Stage of PCT/EP2008/062996 filed Sep. 29, 2008, and claims priority to European Patent Application No. 07425602.5, filed Sep. 28, 2007, the disclosures of all of which are incorporated herein by reference in their entirety.

TECHNICAL FIELD

The present invention relates to a member and method for forming sealed packages of pourable food products from a tube of packaging material.

BACKGROUND ART

Many pourable food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may be defined by a layer of fibrous material, e.g. paper, or mineral-filled polypropylene; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminum foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging units, on which a continuous tube is formed from the web-fed packaging material; and the web of packaging material is sterilized in the packaging unit, e.g. by applying a chemical sterilizing agent such as a hydrogen peroxide solution, which is subsequently removed, e.g. evaporated by heating, from the surfaces of the packaging material.

The sterilized web of packaging material is maintained in a closed, sterile environment, and is folded into a cylinder and sealed longitudinally to form a tube.

The tube is fed in a vertical direction parallel to its axis, and is filled continuously with the sterilized or sterile-processed food product.

The packaging unit interacts with the tube to heat seal it at equally spaced cross sections and so form pillow packs connected to the tube by transverse sealing bands.

More specifically, the unit comprises two forming assemblies movable along respective guides, and which interact cyclically and successively with the tube to heat seal the packaging material of the tube.

Each forming assembly comprises a slide which moves up and down along the respective guide; and two jaws hinged at the bottom to the slide and movable between a closed configuration, in which they cooperate with the tube to heat seal it, and an open configuration, in which they are detached from the tube.

More specifically, the jaws of each forming assembly are moved between the open and closed configurations by respective cams.

The movements of the forming assemblies are offset by a half-period. That is, one forming assembly moves up, with its jaws in the open configuration, while the other forming assembly moves down, with its jaws in the closed configuration, to prevent the assemblies from clashing.

The jaws of each forming assembly are fitted with respective sealing members, which cooperate with opposite sides of the tube, and comprise, for example, a heating member; and a member made of elastomeric material and which provides the necessary mechanical support to grip the tube to the required pressure.

Each forming assembly also comprises two forming members with respective forming half-shells hinged to the respective jaws.

Each two forming half-shells move cyclically between an open position, in which they are detached from the tube, and a closed position, in which they contact the tube and fold the portion of the tube between two consecutive sealing sections to define and control the volume of the package being formed.

More specifically, the sealing device of a first forming assembly seals the bottom of the package being formed, and the half-shells of the first forming assembly control the volume of the package while the sealing device of the second forming assembly seals the top of the package being formed.

More specifically, the forming half-shells may be spring-loaded by respective springs into the open position, and have respective rollers, which cooperate with respective cams designed to move the half-shells into the closed position by the time the forming assembly reaches a predetermined position as it moves down.

Each forming half-shell has a C-shaped cross section, and comprises, integrally, a main wall; and two parallel lateral flaps projecting towards the axis of the tube of packaging material from respective opposite end edges of the main wall.

In the closed position, the main walls are located on opposite sides of the tube axis, are parallel to each other, and cooperate with respective first portions of the tube.

In the closed position, the flaps of one half-shell cooperate with respective second portions of the tube to completely control the volume of the package being formed, and, on the opposite side to the relative main wall, face corresponding flaps on the other half-shell.

Though performing excellently on the whole, packaging units of the type described still leave room for further improvement.

More specifically, a need is felt within the industry to minimize relative slide between the half-shells and the tube of packaging material as the half-shells move from the open to the closed position, so as to prevent marking and/or scratching or, at worst, damage of the packaging material.

When the packaging unit is used to form packages of a larger nominal volume than the volume of the pourable food product inside, i.e. partly empty finished packages, the tube-contacting surface of the main wall of each half-shell has a number of projections, which cooperate with the tube of packaging material to expel part of the pourable food product from the volume of the tube eventually forming the package.

A need is felt within the industry to reduce the amount of pourable food product in the packages, i.e. increase the empty volume of the packages, while at the same time preventing, as far as possible, marking caused by the projections interacting with the package material.

DISCLOSURE OF INVENTION

It is an object of the present invention to provide a forming member, for controlling the volume of packages of pourable food products formed from a tube of packaging material and sealed at a number of cross sections of the tube, designed to meet at least one of the above requirements in a straightforward, low-cost manner.

According to the present invention, there is provided a forming member, for controlling the volume of packages of pourable food products formed from a tube of packaging material and sealed at a number of cross sections of the tube, as claimed in Claim 1.

The present invention also relates to a method of forming packages of pourable food products, formed from a tube of packaging material and sealed at a number of cross sections of the tube, as claimed in Claim 15.

BRIEF DESCRIPTION OF THE DRAWINGS

A preferred, non-limiting embodiment of the present invention will be described by way of example with reference to the accompanying drawings, in which:

With reference to FIGS. 3 to 8, number 1 indicates as a whole a packaging unit for producing sealed packages 3 of a pourable food product, such as pasteurized milk or fruit juice, from a tube 2 of sheet packaging material.

BEST MODE FOR CARRYING OUT THE INVENTION

The packaging material has a multilayer structure (not shown), and comprises a layer of fibrous material, normally paper, covered on both sides with respective layers of heat-seal plastic material, e.g. polyethylene.

In the case of aseptic packages for long-storage products, such as UHT milk, the packaging material also comprises a layer of gas- and light-barrier material, e.g. aluminum foil or ethyl vinyl alcohol (EVOH) film, which is superimposed on a layer of heat-seal plastic material, and is in turn covered with another layer of heat-seal plastic material forming the inner face of the package eventually contacting the food product.

Tube 2 is formed in known manner by longitudinally folding and sealing a web (not shown) of heat-seal sheet material, is filled by a pipe (not shown) with the sterilized or sterile-processed food product for packaging, and is fed, in known manner not shown, along a vertical path having an axis A.

Unit 1 interacts with tube 2 to heat seal it at equally spaced cross sections and form a number of pillow packs 3 (only shown in FIGS. 3 and 5 to 8) connected to tube 2 by sealing bands crosswise to axis A.

Figure 3:
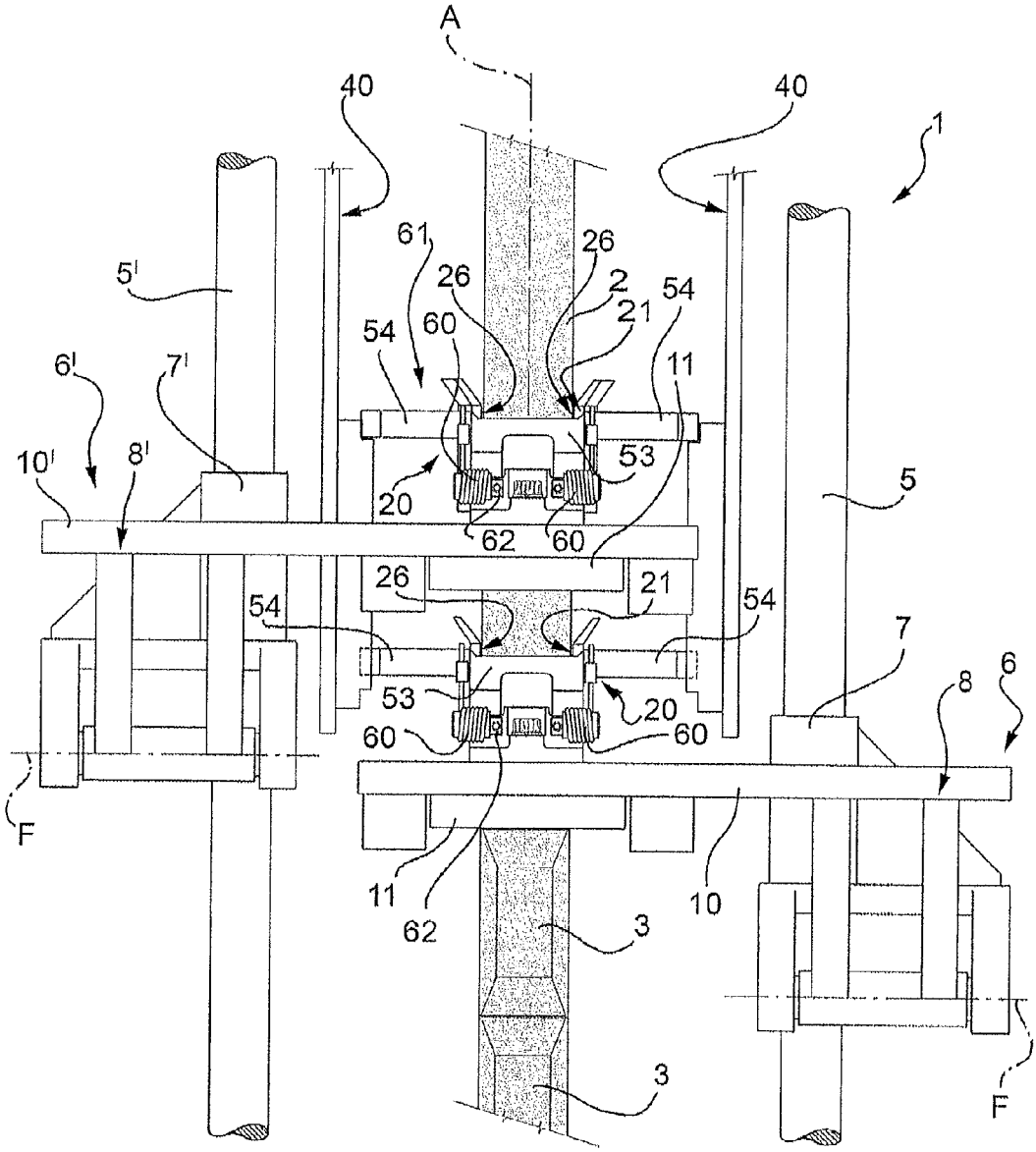
FIG. 3 shows a side view of a packaging unit comprising two pairs of forming members as shown in FIGS. 1 and 2.

With particular reference to FIG. 3, unit 1 comprises two forming assemblies 6, 6', which move vertically along respective vertical cylindrical guides 5, 5' symmetrical with respect to axis A, and interact cyclically with tube 2 to grip and heat seal it along equally spaced cross sections crosswise to axis A.

More specifically, assemblies 6, 6' move upwards along guides 5, 5' from a bottom dead-centre position to a top dead-centre position, and vice versa downwards.

Assemblies 6, 6' being known and identical, only one (assembly 6) is described below, and identical or corresponding parts of assemblies 6, 6' are indicated in the attached drawings using the same reference numbers.

More specifically, assembly 6 substantially comprises a slide 7 (not shown in FIGS. 5 to 8 for the sake of simplicity) that slides along respective guide 5; and two jaws 8 hinged at the bottom to slide 7 about respective horizontal axes F perpendicular to axis A. Jaws 8 are located on opposite sides of tube 2, and are movable, with respect to respective axes F, between a closed configuration (shown in FIGS. 3 and 4 with reference to jaws 8 of assembly 6), in which they grip tube 2, and an open configuration (shown in FIG. 4 with reference to jaws 8' of assembly 6'), in which they are detached from tube 2.

More specifically, each jaw 8 comprises a base portion 10 hinged at its bottom end to a bottom portion of slide 7 about respective axis F; and an arm 11, which interacts with tube 2, is connected to portion 10, and extends perpendicularly to axis A when jaws 8 are closed onto tube 2.

Jaws 8 are therefore moved vertically by slide 7 sliding along guide 5, and open and close with respect to tube 2 of packaging material by rotating about respective axes F about which they are hinged to slide 7; and the open-close movement is superimposed on the up-down vertical movement of slide 7.

The vertical and open-close movements are controlled respectively by known first and second cam actuating devices, not shown by not being essential to a clear understanding of the present invention.

Very briefly, the cam actuating devices provide for rotating jaws 8 in opposite directions and by the same angle about respective axes F.

As shown in FIG. 3, the movements of assemblies 6, 6' are offset by a half-period: assembly 6' travels upwards with jaws 8' open while assembly 6 travels downwards, so that arms 11 of assembly 6 pass between arms 11' of assembly 6' with no interference.

Assembly 6 also comprises a known sealing device, not shown in the drawings, to heat seal each cross section of the tube 2 of packaging material gripped between relative jaws 8.

The sealing device comprises a heating member fitted to arm 11 of one jaw 8, and which interacts with tube 2 by means of two active surfaces; and two pressure pads fitted to arm 11 of the other jaw 8, and which cooperate with respective active surfaces of the heating member to grip and heat seal tube 2.

Assembly 6 also comprises two forming members 20 facing each other on opposite sides of axis A and fitted to respective jaws 8.

Members 20 comprise respective half-shells 21 (FIGS. 1, 2, 4, 9), which are detached from tube 2 as assembly 6, 6' travels upwards, and cooperate with tube 2, during part of the downward travel of assembly 6, 6', to define a space defining the shape and volume of the package 3 being formed between half-shells 21.

Half-shells 21 being identical, only one is described below, and identical or corresponding parts of half-shells 21 are indicated in the attached drawings using the same reference numbers.

More specifically (FIGS. 1-4 and 9), half-shell 21 substantially comprises a flat main wall 25 fixed to a respective jaw 8 and perpendicular to the extension direction of arm 11; and two flaps 26 located on respective lateral sides of wall 25, and both on the axis A side of wall 25.

Wall 25 is bounded by parallel first end edges 27, and by parallel second edges extending between edges 27. More specifically, the second end edges extend perpendicularly to edges 27.

When jaws 8 are in the closed configuration (FIGS. 5 to 9), walls 25 are vertical, parallel to each other, and at a distance with respect to axis A.

In which case, walls 25 cooperate with respective first portions 35 (FIG. 9) of tube 2 extending between two consecutive sealing sections and located on opposite sides of axis A, and edges 27 and the second edges of walls 25 are positioned vertically and horizontally respectively.

Each flap 26 is advantageously movable, with respect to wall 25 of relative member 20, between a first position (FIGS. 4, 7, 9), in which it cooperates with a respective second portion 36, extending between said two sealing sections of tube 2, to control the volume of the package 3 being formed between the two consecutive sealing sections, and a second position (FIGS. 1, 2, 5, 6, 8), in which it is detached from said second portion 36 of tube 2.

Figure 4:
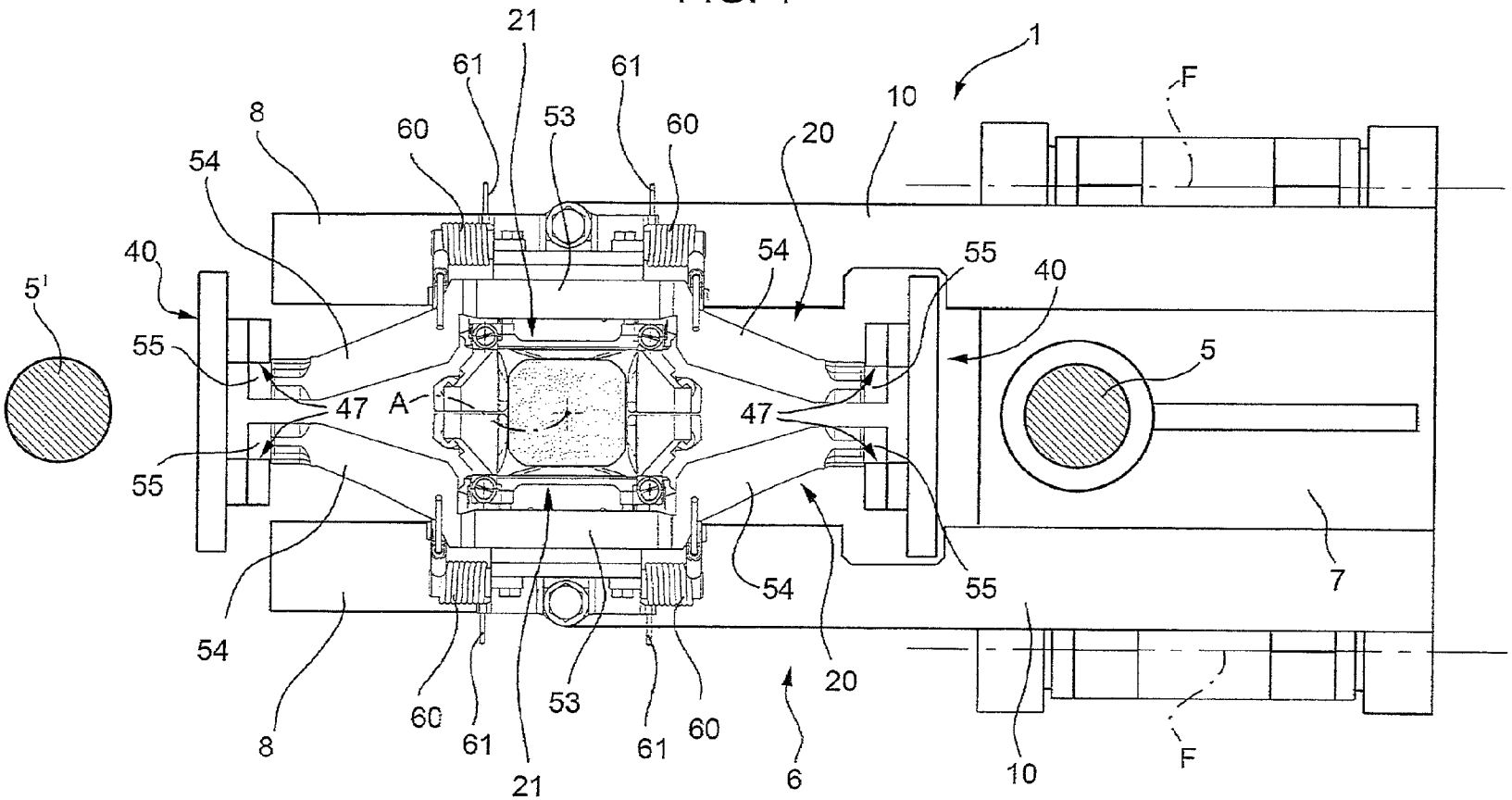
FIG. 4 shows a top plan view of FIG. 3, with parts removed for clarity.
Figure 5:
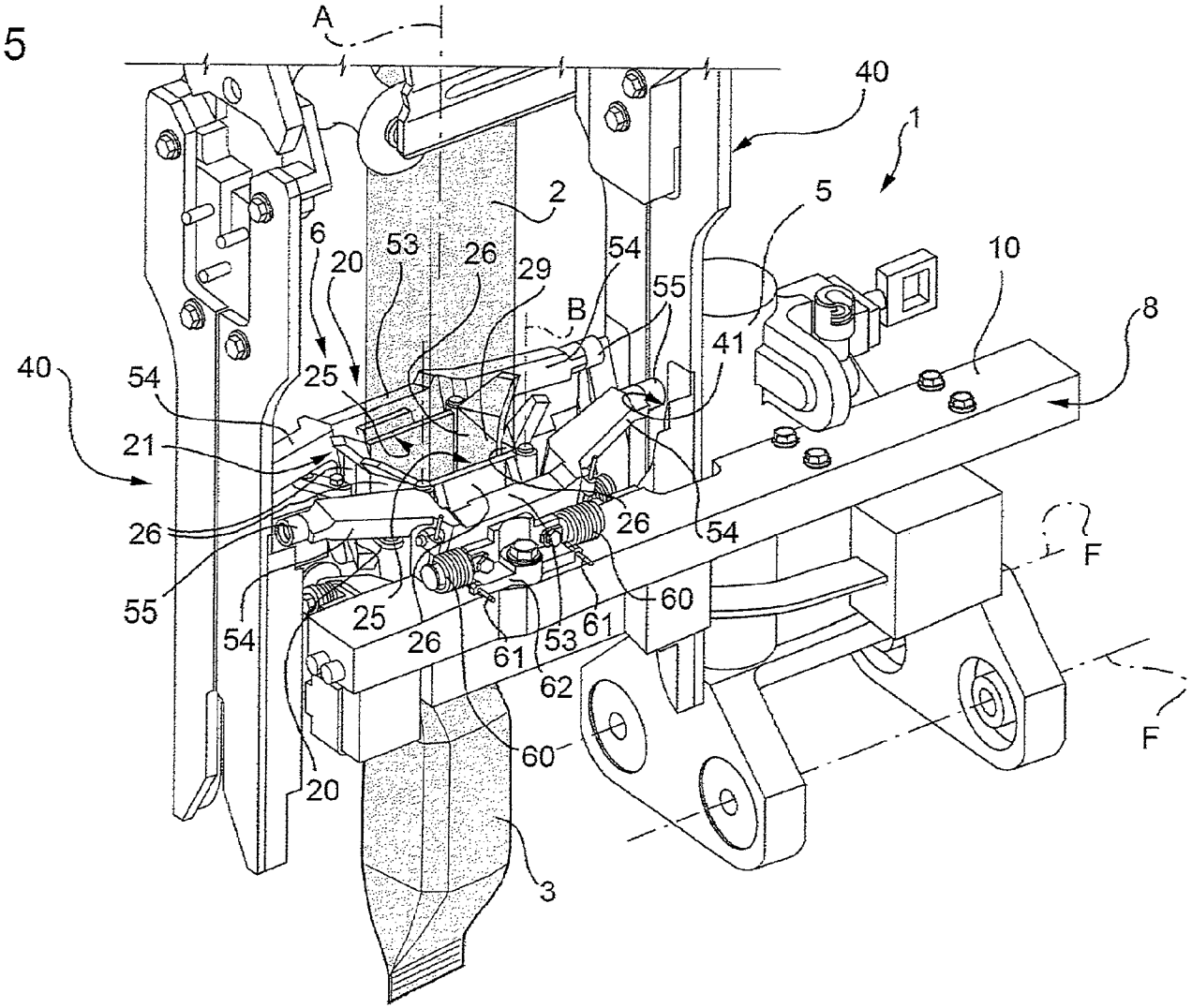
FIGS. 5 and 6 show views in perspective, with parts removed for clarity, of the FIG. 3 unit in successive first and second operating positions.
Figure 6:
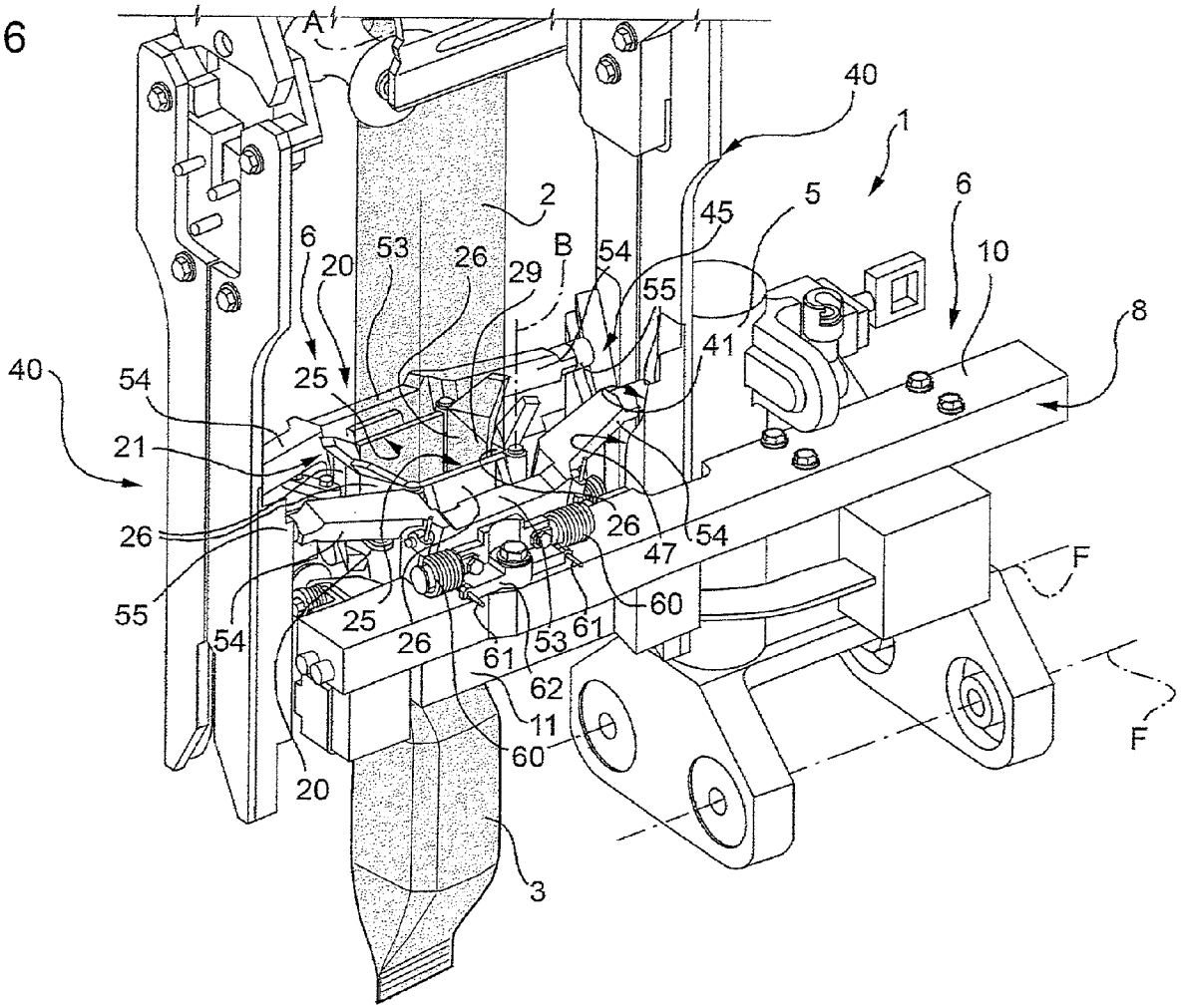
Figure 9:
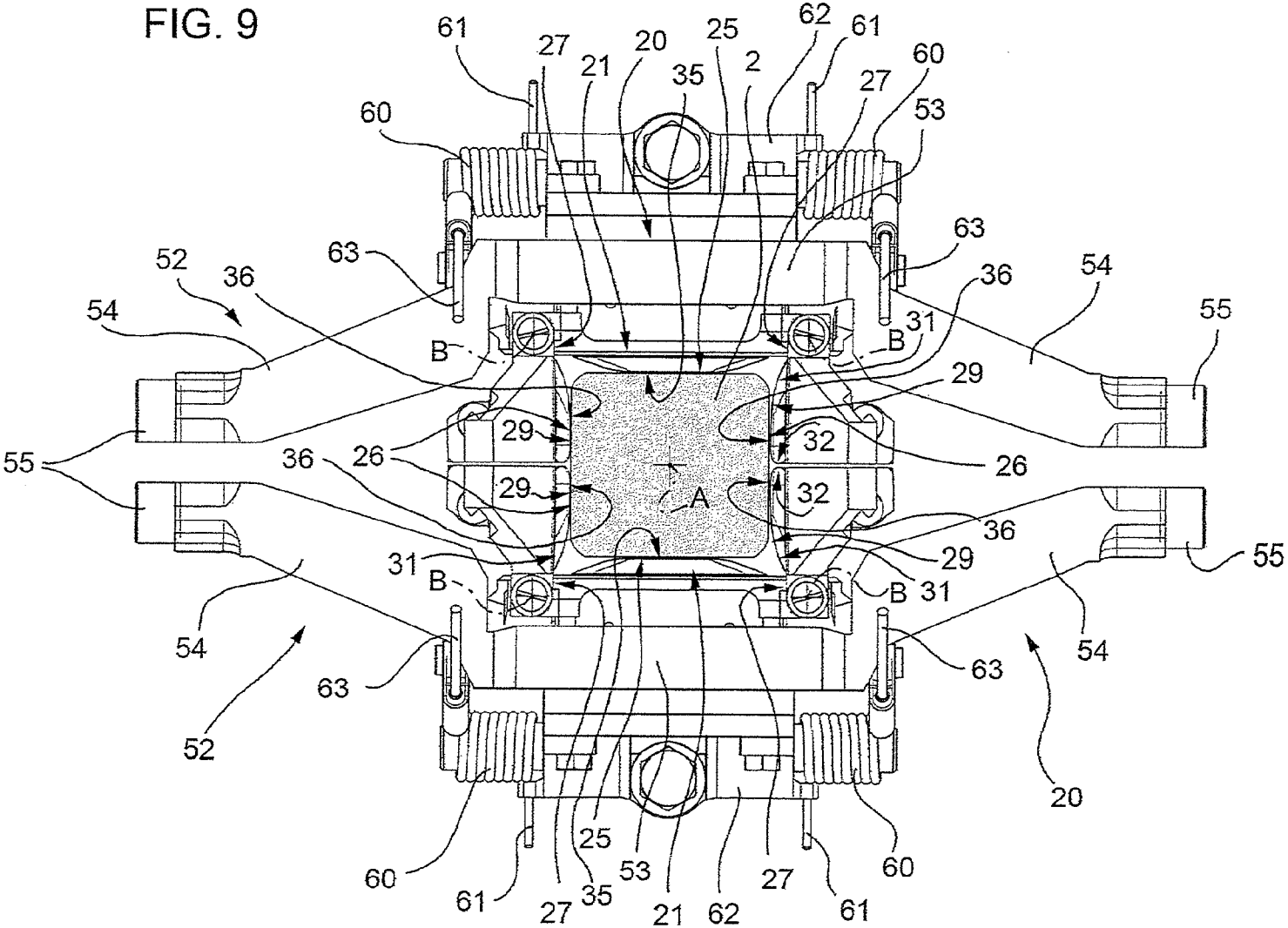
FIG. 9 shows a further view, with further parts removed for clarity, of the packaging unit in the third operating position shown in FIGS. 4 and 7.

Because walls 25 and flaps 26 of members 20 control the volume of package 3 being formed, first portions 35 and second portions 36 lie in respective planes parallel to axis A when respective flaps 26 are in the first position (FIGS. 4 and 9).

More specifically, when flaps 26 are in the first position, first portions 35 are parallel to each other and perpendicular to second portions 36, which are also parallel to each other.

Flaps 26 of each member 20 are loaded elastically into the second position, and, as assembly 6 travels downwards, perform a work cycle comprising, in sequence, a closing stroke (FIGS. 5 and 6), in which flaps 26 approach tube 2, moving from the second position to the first position, and a volume-control stroke (FIG. 7), in which flaps 26 are in the first position and cooperate with respective second portions 36 of tube 2 to control the volume of the package 3 being formed.

After the closing stroke, flaps 26 of each member 20 perform an opening stroke (FIG. 8), in which they withdraw from tube 2, moving from the first to the second position, and a return stroke, in which flaps 26 remain detached from tube 2.

More specifically, each flap 26 (FIGS. 1, 2, 9) comprises a first surface 29, which interacts with respective second portion 36 of tube 2; and a second surface 30 opposite surface 29.

Each flap 26 comprises a first end edge 31 hinged to a respective edge 27 of wall 25 about an axis B; and a free second edge 32 opposite edge 31.

In the first position (FIGS. 7 and 9), edges 32 of flaps 26 of one half-shell 21 face and are parallel to edges 32 of flaps 26 of the other half-shell 21.

When jaws 8 are in the closed configuration and assembly 6 is travelling downwards, axes B and edges 31 are parallel to axis A.

When flaps 26 are in the first position (FIGS. 7 and 9), surfaces 29, 30 lie in respective planes perpendicular to relative walls 25, and cooperate with respective second portions 36 of tube 2 on opposite sides of axis A.

When flaps 26 are in the second position (FIGS. 5 and 6) surfaces 29 lie in respective planes sloping with respect to axis A, and are detached from respective second portions 36 of tube 2.

More specifically, in the second position, the planes of surfaces 29, 30 of flaps 26 are symmetrical with respect to axis A, and converge from edge 32 towards edge 31.

Flaps 26 also comprise respective trapezium-shaped top ends.

At a given point in the downward travel of assembly 6, members 20 interact with two cams 40 on unit 1 to move each flap 26 from the second to the first position.

When cams 40 interact with members 20, relative jaws 8 are therefore in the closed configuration, and walls 25 cooperate with respective first portions 35 of tube 2.

By the time flaps 26 of each member 20 move into the first position, i.e. resting on respective second portions 36 of tube 2, relative wall 25 therefore already cooperates with respective first portion 35 of tube 2.

With particular reference to FIGS. 1, 2, 4 and 3, each member 20 also comprises:

- two levers 51 extending alongside respective edges 27 of wall 25 and hinged to respective edges 27 about a common axis C;
- a body 52 integral with levers 51 and defined by a crosspiece 53 facing wall 25, on the opposite side to axis A, and by two projections 54 projecting integrally from opposite ends of crosspiece 53 and fitted, on their free ends opposite crosspiece 53, with respective cam follower rollers 55; and
- two connecting rods 56, each interposed between a respective projection 54 and surface 30 of a respective flap 26, to convert integral rotation of body 52 and levers 51 towards wall 25 about axis C into rotation of flaps 26 from the second to the first position about respective axes B.

Each connecting rod 56 comprises two end seats 57 (FIG. 1), one engaged by a first pin integral with relative projection 54, and the other by a second pin integral with relative surface 30.

The first and second pin extend in respective directions sloping with respect to each other at angles that vary as relative flap 26 rotates between the closed and open positions.

Flaps 26 of each member 20 are loaded elastically into the second position by two springs 60 fitted to member 20.

Figure 1:
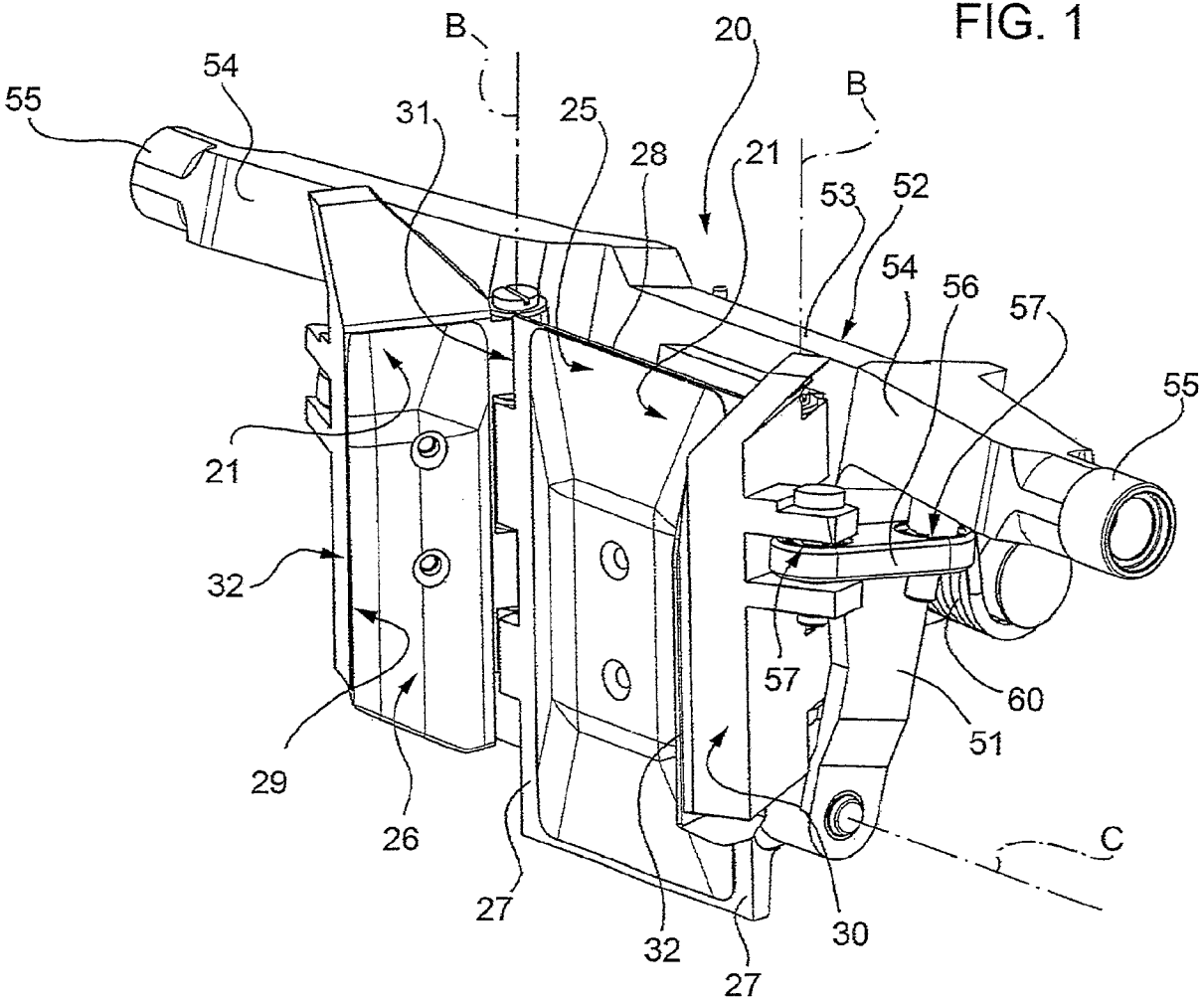
FIGS. 1 and 2 show front and rear views in perspective, respectively, of a forming member in accordance with the present invention.
Figure 2:
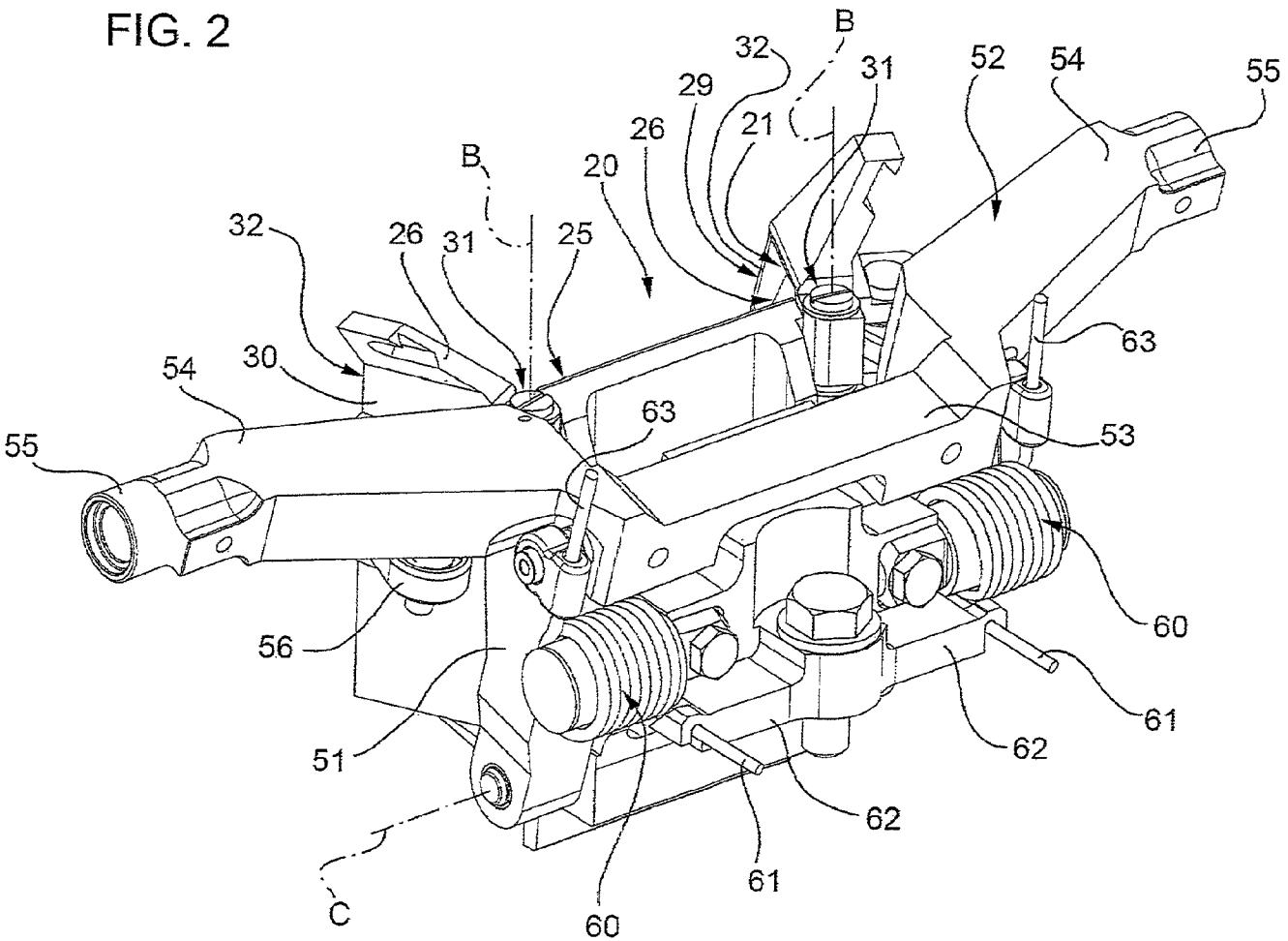

With particular reference to FIGS. 2 and 3, each spring 60 is wound about a respective pin fixed with respect to relative wall 25, and has a first end 61 fixed to a crosspiece 62 projecting integrally from relative wall 25, on the opposite side to axis A, and a second end 63 opposite end 61 and connected functionally to relative crosspiece 53.

More specifically, end 63 of each spring 60 engages a seat defined by a member hinged to crosspiece 53.

Cams 40 (FIGS. 3 to 8) are located on opposite sides of axis A, and each comprise two surfaces 41 facing each other and located on the same side of axis A.

As assembly 6 moves down, one roller 55 of each member 20 cooperates with a relative surface 41 of one cam 40, and the other roller 55 cooperates with a relative surface 41 of the other cam 40.

Cams 40 are positioned so that surfaces 41 interact with relative rollers 55 at a given point in the downward movement of assembly 6 along guide 5.

More specifically, each surface 41 comprises two end portions 45, 46 sloping with respect to axis A; and an intermediate portion 47 between portions 45, 46 and substantially parallel to axis A.

More specifically, portions 45 of surfaces 41 converge, and portions 46 diverge in the downward travelling direction of assembly 6.

Figure 7:
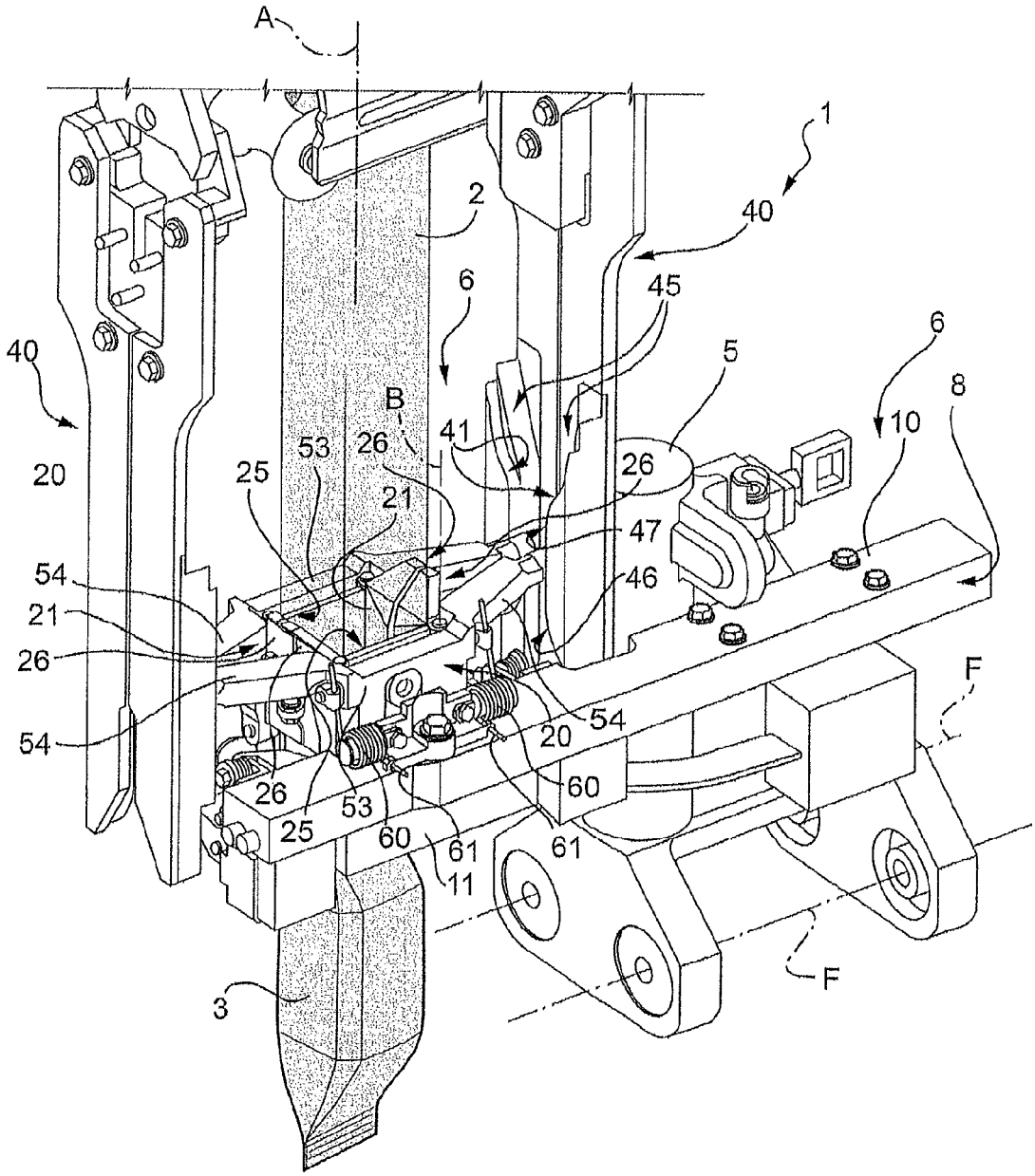
FIG. 7 shows a view in perspective, with parts removed for clarity, of the FIG. 3 unit in a third operating position corresponding to the FIG. 4 condition.
Figure 8:
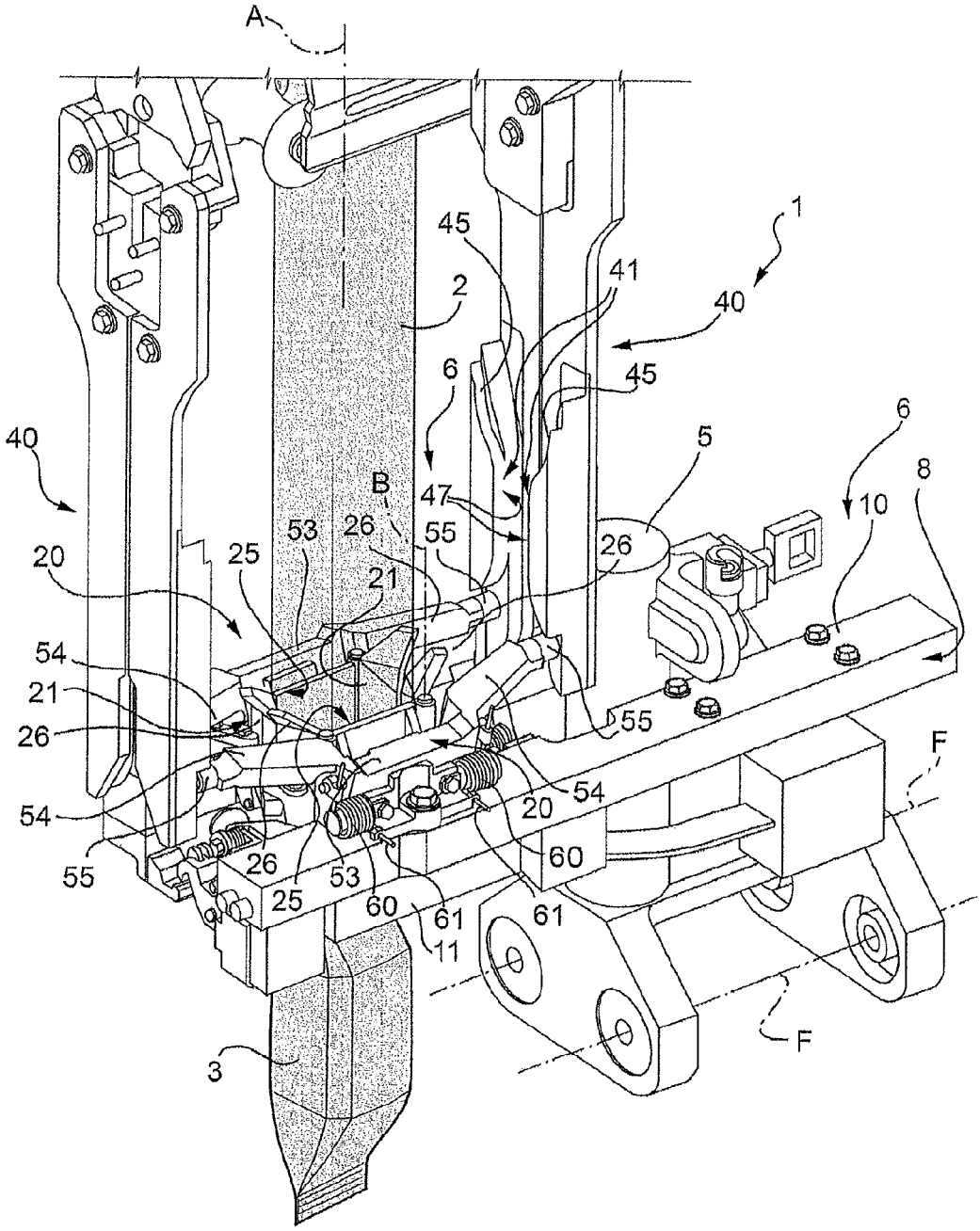
FIG. 8 shows a view in perspective, with parts removed for clarity, of the FIG. 3 unit in a fourth operating position.

As assembly 6 moves down, surfaces 41 of each cam 40 interact with respective facing rollers 55 of relative members 20 to move flaps 26 from the second position (FIGS. 5 and 6) to the first position (FIG. 7).

More specifically, rollers 55 first roll towards each other along portions 45, so that flaps 26 each perform the closing stroke, in opposition to relative springs 60; then roll along portions 47 to keep flaps 26 in the first position; and, finally, roll away from each other along portions 46, so that flaps 26 each perform the opening stroke into the second position, with the aid of relative springs 60.

More specifically, as rollers 55 roll towards each other during the closing stroke, body 52 and levers 51 of each member 20 rotate towards relative wall 25 about relative axis C and in opposition to respective springs 60.

This rotation in turn rotates flaps 26 of each member 20 about respective axes B into the first position by means of connecting rods 56.

Similarly, as rollers 55 roll away from each other, body 52 and levers 51 of each member 20 are rotated by respective springs 60 away from relative wall 25 about relative axis C; which in turn rotates flaps 26 about respective axes B into the second position by means of connecting rods 56.

Cams 40 are also positioned so that, at a given position of assembly 6 along guide 5, rollers 55 disengage cams 40, and springs 60 move respective flaps 26 from the first to the second position.

Surfaces 29 of flaps 26 and wall 25 of each member 20 have projections (not shown), which interact with relative second portions 36 and first portion 35 of tube 2 to expel part of the pourable product from the portion of tube 2 forming package 3 and extending between two consecutive sealing sections.

Said projections therefore provide for forming packages 3 of a larger nominal volume than the food product inside, i.e. partly empty packages.

In actual use, tube 2, filled with the pourable food product, is fed along axis A, and assemblies 6, 6' move up and down, offset by a half-period, along respective guides 5, 5'.

More specifically, as the assemblies move up and down, jaws 8, 8' interact with the relative cam actuating devices to move between the closed configuration, in which they heat seal tube 2 at respective sealing sections, and the open configuration, in which they are detached from tube 2.

More specifically, assembly 6 moves up with jaws 8 open, and, at the same time, assembly 6' moves down with jaws 8' closed, so that arms 11 of assembly 6' pass between arms 11 of assembly 6 with no interference.

Operation of unit 1 is described below with reference to assembly 6 only, and as of the top dead-centre position, in which jaws 8 are in the open configuration.

As of the top dead-centre position, jaws 8 begin moving down, and, as they do so, interact with the respective cam actuating devices to move into the closed configuration.

When jaws 8 are in the closed configuration, walls 25 of forming members 20 cooperate with respective first portions 35 of tube 2, while flaps 26 are maintained in the second position by respective springs 60.

As assembly 6 moves down further, rollers 55 of members 20 (FIGS. 5 and 6) interact, on opposite sides of axis A, with portions 45 of respective cams 40, and so move towards one another.

As a result, levers 51 and body 52 of each member 20 rotate about relative axis C towards relative wall 25.

This rotation is transmitted from projections 54 of each body 52 to respective flaps 26 by respective connecting rods 56, so that flaps 26 rotate about respective axes B into the first position.

More specifically, flaps 26 of each member 20 are in the first position when relative rollers 55 begin cooperating with relative portions 47 (FIG. 7) of relative surfaces 41.

As rollers 55 travel along relative portions 47, flaps 26 of each member 20 are maintained in the first position to permit complete control of the volume of package 3 being formed between two consecutive sealing sections.

Once flaps 26 are set to the first position, the sealing device is activated to seal the bottom of package 3 being formed.

While rollers 55 cooperate with relative portions 47, i.e. while respective flaps 26 are in the first position, the sealing device of jaws 8' seals the top of package 3 being formed.

As the sealing devices are operated, flaps 26 and walls 25 of half-shells 21 cooperate with respective second portions 36 and respective first portions 35 of tube 2 to effectively control the volume and shape of the package 3 being formed between two consecutive sealing sections of tube 2.

As assembly 6 moves down further, rollers 55 of each member 20 (FIG. 8) interact, on opposite sides of axis A, with respective portions 46 of relative surfaces 41, and so move away from one another.

As a result, springs 60 rotate levers 51 and body 52 of each member 20 away from relative wall 25 about axis C.

This rotation is transmitted from projections 54 of each body 52 to respective flaps 26 by respective connecting rods 56, so that flaps 26 rotate about respective axes B into the second position.

As assembly 6 reaches the bottom dead-centre position, jaws 8 move into the open configuration, and walls 25 are detached from respective first portions 35 of tube 2.

Assembly 6 then travels upwards, while assembly 6' travels downwards with jaws 8' in the closed configuration.

The advantages of member 20 and the method according to the present invention will be clear from the above description.

In particular, because flaps 26 move into the first position without sliding along respective second portions 36 of tube 2, friction between second portions 36 and respective flaps 26 is minimized as compared with the known solutions described in the introduction.

As a result, marking and/or scratching of the packaging material of packages 3 is greatly reduced.

Moreover, because flaps 26 move into the first position without sliding on the packaging material of tube 2, flaps 26 may be provided with projections, which interact with second portions 36 of tube 2 to expel part of the pourable product from the portion of tube 2 forming package 3 and bounded laterally by first and second portions 35 and 36, and, parallel to axis A, by two consecutive sealing sections.

As a result, packages 3 can be formed with a much larger nominal volume than the pourable food product inside, without marking the packaging material of the finished packages 3.

Clearly, changes may be made to member 20 and the method as described herein without, however, departing from the scope as defined in the accompanying Claims.

In particular, walls 25 of members 20 may be hinged to respective jaws 8.

In which case, surfaces 41 of cams 40 would interact with respective rollers 55, so that walls 25 cooperate first with respective first portions 35 of tube 2, and flaps 26 subsequently cooperate with respective second portions 36 of tube 2.

Cams 40 may also be replaced by servomotors.

The invention claimed is:

1. A packaging unit for producing sealed packages of pourable food products from a tube of packaging material, comprising:

a sealing assembly comprising at least one jaw configured to rotate into a position in which a section of the tube of packaging material is gripped and sealed;

a forming member configured to control a volume of a portion the tube while the section of the tube is gripped and sealed by the sealing assembly, the forming member having a main wall hinged to the at least one jaw of the sealing assembly and adapted to cooperate with a first subportion of the portion of the tube, and a flap connected to the main wall, wherein the flap is movable with respect to the main wall between a first position, in which it cooperates with a second subportion of the portion of the tube to control the volume of the portion of the tube, and a second position, in which it is detached from the second subportion of the portion of the tube;

a body hinged to the main wall;

an interaction surface provided on the body;

a control member operable to engage the interaction surface to move the flap into the other of the first and second positions; and a connecting member interposed between the body and the flap so that rotation of the body rotates the flap, wherein the body and the flap rotate about different respective axes.

2. A packaging unit as claimed in claim 1, wherein the flap is hinged to the main wall.

3. A packaging unit as claimed in claim 1, further comprising an elastic member for loading the flap into one of the first and second positions.

4. A packaging unit as claimed in claim 3, wherein the control member engages the interaction surface to move the flap into the other of the first and second positions, in opposition to the elastic member.

5. A packaging unit as claimed in claim 3, wherein the elastic member loads the flap into the second position.

6. A packaging unit as claimed in claim 3, wherein the elastic member is interposed between the body and the flap.

7. A packaging unit as claimed in claim 1, wherein the flap comprises a first surface cooperating with the second subportion in the first position, and a second surface opposite the first surface.

8. A packaging unit as claimed in claim 7, wherein the connecting member comprises a connecting rod connected at opposite ends to the second surface of the flap and to the body, respectively, the connecting rod converting rotation of the body towards the main wall into rotation of the flap from the second position to the first position.

9. A method of producing sealed packages of pourable food products from a tube of packaging material, comprising:

rotating at least one jaw into a position in which a section of the tube of packaging material is gripped and sealed;

controlling a volume of a portion the tube while the section of the tube is gripped and sealed, by moving a main wall which is hinged to the at least one jaw into cooperation with a first subportion of the portion of the tube, and moving a flap with respect to the main wall into cooperation with a second subportion of the portion of the tube; and rotating a body hinged to the main wall, to thereby rotate the flap, wherein the body and the flap are rotated about different respective axes.

10. The method as claimed in claim 9, wherein the flap is moved in opposition to an elastic load provided by an elastic member.

11. A packaging unit for producing sealed packages of pourable food products from a tube of packaging material, comprising:

a sealing assembly configured to grip and seal a section of the tube of packaging material;

a forming member configured to control a volume of a portion the tube while the section of the tube is gripped and sealed by the sealing assembly, the forming member having a main wall hinged to a jaw of the sealing assembly and adapted to cooperate with a first subportion of the portion of the tube, and a flap connected to the main wall, wherein the flap is movable with respect to the main wall between a first position, in which it cooperates with a second subportion of the portion of the tube to control the volume of the portion of the tube, and a second position, in which it is detached from the second subportion of the portion of the tube;

an elastic member for loading the flap into one of the first and second positions;

a body hinged to the main wall; and a connecting member interposed between the body and the flap so that rotation of the body rotates the flap, wherein the body and the flap rotate about different respective axes.

12. A packaging unit as claimed in claim 11, wherein the flap is hinged to the main wall.

13. A packaging unit as claimed in claim 11, further comprising a control member operable to engage an interaction surface provided on the body to thereby move the flap into the other of the first and second positions, in opposition to the elastic member.

14. A packaging unit as claimed in claim 11, wherein the elastic member loads the flap into the second position.

15. A packaging unit as claimed in claim 11, wherein the elastic member is interposed between the body and the flap.

16. A packaging unit as claimed in claim 11, wherein the flap comprises a first surface cooperating with the second subportion in the first position, and a second surface opposite the first surface.

17. A packaging unit as claimed in claim 16, wherein the connecting member comprises a connecting rod connected at opposite ends to the second surface of the flap and to the body, respectively, the connecting rod converting rotation of the body towards the main wall into rotation of the flap from the second position to the first position.

18. A method of producing sealed packages of pourable food products from a tube of packaging material, comprising:

gripping and sealing a section of the tube of packaging material by at least one jaw;

controlling a volume of a portion the tube while the section of the tube is gripped and sealed by the sealing assembly, by moving a main wall which is hinged to the at least one jaw of the sealing assembly into cooperation with a first subportion of the portion of the tube, and moving a flap with respect to the main wall into cooperation with a second subportion of the portion of the tube; and rotating a body hinged to the main wall, to thereby rotate the flap, wherein the body and the flap are rotated about different respective axes.

19. The method as claimed in claim 18, wherein the flap is moved in opposition to an elastic load provided by an elastic member.

* * * * *